United States Patent [19]

Treharne

[11] Patent Number: 4,536,228

[45] Date of Patent: Aug. 20, 1985

[54] CORROSION INHIBITION IN SINTERED STAINLESS STEEL

[75] Inventor: Timothy J. Treharne, East Grinstead, United Kingdom

[73] Assignee: Pemberton Sintermatic S.A., Switzerland

[21] Appl. No.: 467,130

[22] PCT Filed: Jun. 9, 1982

[86] PCT No.: PCT/GB82/00172

§ 371 Date: Feb. 3, 1983

§ 102(e) Date: Feb. 3, 1983

[87] PCT Pub. No.: WO82/04444

PCT Pub. Date: Dec. 23, 1982

[30] Foreign Application Priority Data

Jun. 9, 1982 [GB] United Kingdom ..... 8117814

[51] Int. Cl.[3] ..... C23F 7/10

[52] U.S. Cl. ..... 148/6.15 R; 148/31.5

[58] Field of Search ..... 419/30, 35, 26; 106/14.12; 148/6.15 R, 6.15 Z; 252/147, 389.2; 422/18, 12, 15; 428/403, 704, 457

[56] References Cited

U.S. PATENT DOCUMENTS

| | | | |
|---|---|---|---|
| 2,476,345 | 7/1949 | Zavarella | 148/6.15 R |
| 2,521,580 | 9/1960 | Hornak et al. | 148/6.15 R |
| 2,927,873 | 3/1960 | Bengtsson et al. | 148/6.15 R |
| 4,168,983 | 9/1979 | Vittands et al. | 422/12 X |
| 4,194,929 | 3/1980 | Menke | 148/6.15 R |
| 4,362,577 | 12/1982 | Jones | 148/6.15 R |
| 4,384,900 | 5/1983 | Gotta et al. | 148/6.15 R |
| 4,420,336 | 12/1983 | Klar et al. | 419/2 X |

OTHER PUBLICATIONS

Ro, D. H. and E. Klar, "Corrosion Behavior of P/M Austentic Stainless Steel", in *Modern Developments in Powder Metallurgy,* vol. 13, 1981, pp. 247–287.

Tikkanen, M. H. A., "Modern Methods on Studying Corrosion Resistance of Sintered Stainless Steels".

*Primary Examiner*—Edward A. Miller

*Assistant Examiner*—Matthew A. Thexton

*Attorney, Agent, or Firm*—Neil F. Markva

[57] ABSTRACT

A method of enhancing the corrosion resistance of sintered stainless steel, particularly against attack by acids, such as acetic acid, under non-oxidizing conditions. The sintered stainless steel is activated, for example by treatment with acid and is then treated with a phosphate containing solution. The sintered stainless steel has improved resistance to subsequent attack by acid.

9 Claims, No Drawings

CORROSION INHIBITION IN SINTERED STAINLESS STEEL

FIELD OF THE INVENTION

This invention relates to the inhibition of corrosion in sintered stainless steel.

BACKGROUND OF THE INVENTION

Stainless steel generally owes its good corrosion resistance to a passivating film of chromic oxide. It has been found that sintered stainless steel has a lower corrosion resistance than the wrought metal even when passivated, for example by treatment with nitric acid. There may be several reasons for this, including inadequate passivation and an increase in pitting corrosion caused by the porosity of the sintered material. These problems are particularly serious in the case of attack by acid solutions in non-oxidizing conditions or e.g. hot chloride solutions. In normal circumstances, while acid attacks the passivating film of oxide, the film is constantly being replenished. If there is de-aeration of the solution, however, breakdown of the film occurs rapidly.

Sintered stainless steel has therefore been thought unsuitable for use in the presence of such corrosive materials. Where a sintered material is necessary, e.g. for use as a filter, substances such as sintered glass may be used but these present their own problems. In the food industry in particular it may be necessary to ensure that particles or fragments of a sintered filter do not pass into food products—the use of sintered stainless steel filters might therefore be much preferable to the use of sintered glass filters as the detection of stainless steel fragments would be more easily achieved than that of glass fragments.

It has been proposed, in U.K. Patent No. 2004454B to mold a sausage in a sintered mold and to pass acetic or another acid through the wall of the mold to treat the surface of the sausage. In tests it was found that with molds of sintered stainless steel, after using acetic acid, the molds became clogged with a dark deposit and virtually unusable.

It has also been found that when using sintered stainless steel filters in the filtration of whisky, the whisky becomes discolor. Indeed, in a test, when a piece of sintered stainless steel was immersed in whisky, discoloration was rapid. Investigations have shown whisky to have a relatively low pH of say 3.6, with between 80% and 90% of the acid content being acetic. It is thus considered that the problem encountered may correspond to that in the case of sausage molding as described above.

There is thus a distinct problem in that while sintered stainless steel might be considered a useful material in for example the processing of food or drink, it suffers badly from corrosion problems. These have been particularly noted in the case of acetic acid and would be expected with other acids.

The object of the invention is therefore to reduce or eliminate these substantial corrosion problems.

SUMMARY OF THE INVENTION

According to one aspect of the invention there is thus provided a method of producing sintered stainless steel of enhanced corrosion resistance which method comprises the treatment of at least partially activated interior surfaces of the sintered stainless steel with a phosphate containing solution.

The phosphate layer might be produced by treating active sintered stainless steel in a manner known for other steels, for example by immersing the sintered stainless steel in a solution of phosphoric acid containing e.g. iron phosphates. It has however been found that effective results can be obtained by the use of alkaline solutions of for example sodium pyrophosphate or trisodium orthophosphate. Thus readily available food grade alkalis, such as these, can be used in aqueous solution. In the case of already passivated sintered stainless steel it may be necessary to remove the protective oxide layer before treating with phosphate but this presents no problems. Mere treatment with e.g. acetic acid causes depletion of the oxide layer as is known from the corrosion problems which have been encountered.

According to a further aspect of the invention there is provided a sintered stainless steel having a protective surface layer on interior surfaces thereof generated by treatment with a phosphate-containing solution or the like.

It has surprisingly been found that if, rather than attempting to maintain or enhance the oxide protective layer (generally a $Cr_2O_3$ protective layer) conventionally present, sintered stainless steel is at least partially activated by removal of oxide protective layer from interior surfaces and is subsequently treated with a phosphate containing solution, the resistance of the sintered stainless steel to corrosion under non-oxidizing conditions, and particularly to corrosion by aqueous organic acid solutions, is enhanced.

While it is well known that phosphate coatings can be applied to ordinary steels to improve their corrosion resistance, it has not been proposed previously to replace the normally effective passivating oxide layer on stainless steel by a phosphate layer. There is however an important advantage of a phosphate layer on the interior surfaces of sintered stainless steel, this being that it is insoluble in acetic and other acids. Thus while previous proposals have involved the use of an alternative material for acidic environments it has been found that by using an alternative passivating layer, effective corrosion resistance can be obtained.

Thus, sintered stainless steel in accordance with the invention can be used in processes such as those outlined above where acetic acid is involved and conventionally passivated sintered stainless steel corrodes. The sintered stainless steel in accordance with the invention is particularly suitably used in the form of filters or molds, for example for use in the foodstuffs industry.

It has been found that sintered stainless steel which has been treated with phosphate can be used in the sausage molding process outlined above, without clogging with deposits. Furthermore, sintered stainless steel thus treated has been immersed in proprietary whisky and no discoloration observed after several hours.

In the case of the molds for sausages as described above, passivated stainless steel initially supplied can be subjeced to a preliminary run using acetic acid to attack the conventional protective film of oxide followed by a run using phosphate.

To ensure that the phosphate layer remains, further treatment on a periodic basis may be desirable. In the case of the manufacture of sausages for example, the apparatus may be flushed through with phosphate at the end of each day's run. Care must be taken, however, to ensure that phosphate deposits do not clog the sintered material. A particular advantage of using phosphates is that food grade phosphates are readily available. Thus, periodic treatment of the sintered stainless steel can be carried out in food and drink processes without great problems.

According to a yet further aspect of the invention there is provided a method of inhibiting corrosion in a sintered stainless steel element through which passes an acidic solution, preferably an aqueous acetic acid solution, wherein passage of the acidic solution is terminated, and a phosphate containing solution is passed through the element, following which the passage of the acidic solution is recommenced.

The use of the phosphate containing solution should be as soon as possible after the termination of the acidic solution. If this is not so, corrosion products may be accumulated; in the case of acetic acid these can be rinsed away by the use of further acetic acid. After use of the phosphate containing solution, air may be passed through the sintered stainless steel element. It may be desirable however to flush through with acid or water.

It will be appreciated that not all of the interior surfaces of the sintered stainless steel may be provided with a phosphate layer. For example, if oxide passivated sintered stainless steel is subjected to acetic acid, it may be that removal of the oxide layer will only be at certain points within the sintered material. If the phosphate treatment itself, or any pre-treatment, is not such as to attack the oxide layer then a phosphate layer will only be formed at such points.

It will be appreciated that from one aspect the invention can be considered as the use of phosphate treated sintered stainless steel in food or drink processing in acidic environments; or as the use of such material in the processinag of alcohol, and particularly whisky. The invention is applicable in the case of acidic environments where there is acetic acid, and is expected to be applicable in the case of other organic, particularly carboxylic, acids.

In the case of normal, i.e. non-sintered stainless steels, phosphates are known to provide protective layers which resist a wide range of corrosive environments and it is therefore expected that sintered stainless steel in accordance with the invention will be of use in such environments.

DETAILED DESCRIPTION

An embodiment of the invention will now be described by way of example only:

In apparatus substantially in accordance with U.K. Patent No. 2004454B, sintered stainless steel molds were used. The stainless steel had the designation 316L and the analysis from the British Steel Corporation was as follows:

| | Max. % | Min. % |
|---|---|---|
| C | 0.07 | 0.00 |
| Si | 1.00 | 0.20 |
| Mn | 2.00 | 0.50 |
| Ni | 13.00 | 10.00 |
| Cr | 18.50 | 16.50 |
| Mo | 3.00 | 2.25 |
| Ti | 0.00 | 0.00 |
| S | 0.03 | 0.00 |
| P | 0.045 | 0.000 |
| Fe | approx. 65% | |

In the preparation of sausages an aqueous solution of acetic acid of pH 2.25 was passed through the mold walls. After termination of use of the apparatus a dark colored deposit formed gradually. After one run with new molds, the amount of deposit eventually formed was not great. After two days, however, the amount of deposit was such as to severely restrict the flow of acid. The deposit did not form immediately when use of the apparatus was terminated, but appeared gradually. The deposit could be cleared to a certain extent by flushing through with more acetic acid, but it reappeared after the flow was terminated and the porosity of the sintered stainless steel was reduced.

An analysis of acid which had passed through a fresh untreated mold, showed the following metal contents:

| | |
|---|---|
| Fe | 0.7 ppm |
| Cr | less than 0.2 ppm |
| Ni | less than 0.1 ppm |

After a mold had been left standing for two weeks—after use with the acid—it was found that a new run with acetic acid resulted in the acid having the following metal contents:

| | |
|---|---|
| Fe | 190 ppm |
| Cr | 23 ppm |
| Ni | 42 ppm |

This is an indication of the extent of corrosion when the mold is left in an acidic environment without a continuous flow.

Analysis of the solid deposit showed it to have the following metal contents:

| | |
|---|---|
| Fe | 21.8% w/w |
| Ni | 2.59% w/w |

In accordance with the invention, after initial clearing of the deposit with acetic acid, the molds were flushed through with an aqueous solution of trisodium orthophosphate having a pH of about 11.7 for a period of say, 5 to 10 minutes. Following that, air was pumped through the molds. It was found that no deposits formed, and that even after further use of the molds with the acetic acid solution, no such deposits appeared. From this it was deduced that a protective layer of e.g. ferric phosphate had been formed at least in those regions where acid attack would normally take place.

It having been discovered that sintered stainless steel filters were discoloring whisky, an analysis was sought as regards the acid content of such whisky. It was found that proprietary whisky has an acid content of about 15–23 grams per 110 l of which about 80%–90% is acetic. The pH of a proprietary blended whisky was found to be about 3.6.

A sample of the sintered stainless steel used in the sausage molding process just described, prior to any phosphate treatment was immersed in a sample of proprietary whisky ("Bells"—Trade Mark), which was discolored within twenty minutes. A sample of the phosphate treated sintered stainless steel—taken from the sausage molding apparatus—was then immersed in a fresh sample of the same proprietary whisky. No discoloration was noted even after several hours.

It will thus be appreciated that the invention permits sintered stainless steel to be used in corrosive conditions which before could not be tolerated. It has been stated previously that there is no sense in using sintered stainless steel in acidic solutions in non-oxidizing conditions. It has now been found that at least in the case of acetic acid solutions under the conditions described—where access of oxygen to the interior of the sintered stainless steel is restricted—the invention permits sintered stainless steel to be used.

While the use of food grade phosphates to generate the replacement passivating layer on the sintered stainless steel according to the methods of the invention is preferred where the sintered stainless steel is to be used in the foodstuffs industry, it is anticipated that the present invention extends beyond this to include the use of materials having equivalent anticorrosive properties to phosphate such as chromates, oxalates etc to generate conversion coatings such as chromate, oxalate, or other inorganic coatings, as the protective layer in place of the oxide surface layer on sintered stainless steel. As a further possibility, the use of a two-stage treatment of at least partially activated sintered stainless steel has been considered; in such a process a treatment with a phosphate containing solution might be followed by treatment with an acid chromate solution.

According to a yet further aspect of the invention there is therefore provided a method of treatment of sintered stainless steel wherein on at least partially activated interior surfaces thereof is generated a protective surface layer substantially resistant to corrosion by agents which attack conventionally passivated stainless steel, such as acid solutions in non-oxidizing conditions. Thus, the method of this invention is useful to enhance the corrosion resistance of sintered stainless steel articles. This method of treatment comprises passing such an article through a material which generates a conversion coating on interior surfaces of the article. The invention also extends to stainless steel so treated.

I claim:

1. A process for the treatment of a sintered stainless steel element to enhance its corrosion resistance, the element being porous having pores with interior surfaces and for use in an environment in which aqueous acetic acid solution will be passed through the element, said process comprising the steps of:

(a) passing a preliminary flow of an aqueous acetic acid solution through the element in an amount sufficient to at least partially activate the interior surfaces of pores in the elements, (b) terminating the preliminary flow of acetic acid, then (c) passing a flow of a phosphate containing solution through the element within a period of time short enough after terminating the flow of acid to prevent excessive accumulation of corrosion products within the pores to generate a corrosion resistant coating on the previously activated interior surfaces of the element, and (d) terminating the flow of phosphate containing solution, (e) said corrosion resistant coating being effective to resist corrosion by subsequent flows of aqueous acetic acid solution through the element.

2. A process as claimed in claim 1 wherein the phosphate containing solution is an aqueous alkaline phosphate solution.

3. A process as claimed in claim 1 wherein the phosphate containing solution is a sodium pyrophosphate or trisodium orthophosphate solution.

4. A process as claimed in claim 1 wherein the sintered stainless steel element is for use as a filter or mold in a foodstuff manufacturing process where food-grade aqueous acetic acid solution is then to be passed through the element, and the aqueous acetic acid solution of the preliminary flow and the phosphate containing solution are food-grade.

5. A porous, sintered stainless steel element adapted for use as a porous mold or filter in a foodstuff manufacturing process, said element being treated for corrosion resistance in accordance with the process as defined in claim 1.

6. A method of inhibiting corrosion in a porous, sintered stainless steel element having interior surfaces wherein the element is subject in use to corrosive acidic solutions, said method comprising the steps of:

(a) passing a non-oxidizing acidic solution through the porous element to deplete any oxide layer present on the interior surfaces, (b) terminating the passage of the acidic solution, and then (c) passing a phosphate containing solution through the element to form a passivating phosphate layer on the interior surfaces, and then (d) again passing the acidic solution through the element.

7. A method as claimed in claim 6 wherein the phosphate containing solution passing step is repeated periodically.

8. A method as defined in claim 6 wherein the phosphate containing solution is an aqueous alkaline phosphate solution.

9. A method as defined in claim 6 wherein the phosphate containing solution is a sodium pyrophosphate or trisodium orthophosphate solution.

* * * * *